United States Patent [19]

Grossman

[11] 4,314,675

[45] Feb. 9, 1982

[54] GRAIN BIN DISCHARGE GUARD

[75] Inventor: Rodney Grossman, New Paris, Ind.

[73] Assignee: Brock Manufacturing, Inc., Milford, Ind.

[21] Appl. No.: 110,327

[22] Filed: Jan. 7, 1980

[51] Int. Cl.[3] ..... B02C 18/00

[52] U.S. Cl. ..... 241/95; 241/101.2; 414/306

[58] Field of Search ..... 241/95, 96, 101 A, 101.2, 241/101.5, 27 X; 414/288, 306–312, 328, 329

[56] References Cited

U.S. PATENT DOCUMENTS

| | | | |
|---|---|---|---|
| 3,414,142 | 12/1968 | Kolze | 414/307 |
| 3,451,566 | 6/1969 | Hanson | 241/101.5 X |
| 3,536,210 | 10/1970 | Dickinson | 414/310 |

FOREIGN PATENT DOCUMENTS

| | | | |
|---|---|---|---|
| EP-937 | 3/1979 | European Pat. Off. | 414/309 |
| 64046 | 8/1892 | Fed. Rep. of Germany | 414/288 |
| 2127570 | 10/1979 | Fed. Rep. of Germany | 414/306 |
| 2379968 | 1/1978 | France | 414/310 |

*Primary Examiner*—Howard N. Goldberg

*Attorney, Agent, or Firm*—Trexler, Bushnell & Wolters, Ltd.

[57] ABSTRACT

There is disclosed a guard for the discharge opening of a grain bin which assures free flow of grain therethrough by precluding blockage of the opening by compacted grain. The guard includes a plurality of blades which are adapted to be disposed over the opening. The blades extend substantially perpendicularly to the opening and include grain engaging cutting edges for cutting and breaking-up compacted grain over the discharge opening to assure free flow of grain therethrough. The guard is also readily removable from its operative position over the discharge opening to permit complete emptying of the bin by a sweep auger.

19 Claims, 4 Drawing Figures

GRAIN BIN DISCHARGE GUARD

BACKGROUND OF THE INVENTION

The present invention is generally directed to grain bins and more particularly to a guard apparatus to assure free flow of grain through the bin discharge opening.

Bins for storing grain commonly take the form of covered shelters. A sump or center well is provided below a discharge opening in the center of the bin floor. As a result, when grain is drawn from the bin, the grain flows through the discharge opening by gravity feed into the center well.

In the usual case, an auger conveyor or the like is positioned in communication with the center well. It receives the grain passing through the discharge opening and conveys the same to a point of utilization external to the bin.

It is also common practice to periodically completely empty such grain bins. To this end, a sweep auger is introduced into the bin with its discharge end over the discharge opening. As the sweep auger sweeps the bin, it conveys the grain to the discharge and the center well. The auger in communication with the center well is then enabled to convey the grain from the bin for totally emptying the bin.

In many cases, grain is stored in such bins for a considerable period of time. After long storage, a small quantity of the grain can form large chunks of compacted grain. As grain is removed from the bin, these chunks of grain can bridge across the discharge opening and thus form a blockage in or over the bin center well. Obviously, this can hamper or in some cases totally impede grain removal from the center well by the auger conveyor.

It is therefore a general object of the present invention to provide a guard apparatus for the discharge opening of a grain bin which encourages free flow of grain to and through that opening.

It is a more particular object of the present invention to provide such a guard which breaks up compacted grain chunks over the grain bin discharge opening.

It is another object of the present invention to provide a guard apparatus which is arranged to direct unbroken chunks downwardly and away from the discharge opening as grain is removed from the bin. A related object is to provide a guard which will engage and stop chunks of grain that can not be cut up and will not slide off, and hold them above the discharge opening in such a manner as to permit grain to continue flowing into the opening from the sides and underneath the knife blades of the apparatus.

It is a still further object of the present invention to provide such a grain bin discharge opening guard apparatus which may be fixed against lateral movement in an operative position above the discharge opening but is also portable and adapted to be removed from its operative position to permit the introduction of a sweep auger into the grain bin with its discharge end over the discharge opening to facilitate complete emptying of the grain bin.

The invention therefore provides a guard apparatus for the discharge opening of a grain bin to preclude blockage of the opening by compacted grain. The guard apparatus includes a knife means including a plurality of spaced apart blades which are adapted to be disposed across the discharge opening. The array of blades extends substantially perpendicularly to the discharge opening, and provides a number of grain-engaging cutting edges for cutting and breaking up compacted grain over the discharge opening. As a result, free flow of grain through the discharge opening is encouraged.

In a preferred form, the plurality of blades define a plurality of knife units wherein each knife unit defines a closed perimeter and wherein the knife units are concentrically arranged with respect to each other.

BRIEF DESCRIPTION OF THE DRAWINGS

The features of the present invention which are believed to be novel are set forth with particularity in the appended claims. The invention, together with further objects and advantages thereof, may best be understood by making reference to the following description taken in conjunction with the accompanying drawings, and the several figures in which like reference numerals identify identical elements, and wherein:

DESCRIPTION OF THE PREFERRED EMBODIMENT

While the invention will be described in connection with a preferred embodiment, it will be understood that it is not intended to limit the invention to this embodiment. On the contrary, it is intended to cover all alternatives, modifications, and equivalents as may be included within the spirit and scope of the invention.

Figure 1:
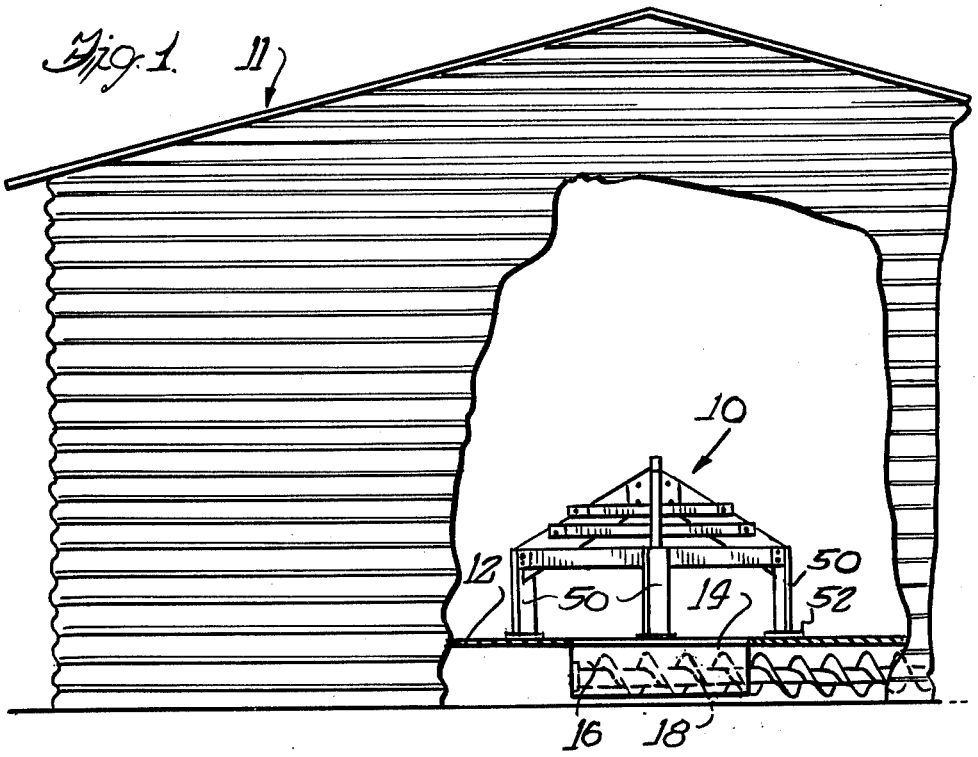
FIG. 1 is a partial side plan view, partly cut away and partly in cross-section, illustrating a preferred embodiment of guard apparatus embodying the present invention employed within a grain bin.

Turning now to the drawings, and initially to FIG. 1 thereof, a guard apparatus 10 embodying the present invention is disposed in an operative position within a grain storage bin 11. The storage bin 11 takes the form of a covered shelter and includes a bottom floor 12 having a discharge opening 14. Beneath the dicharge opening 14 there is provided a sump or center well 16. Within the center well 16 there is disposed a conveyor auger 18 which is adapted to be rotated by a suitable motor (not shown).

When grain within the storage bin 11 is to be removed therefrom, the auger 18 is caused to be rotated by the motor. The grain within the bin then flows through the opening 14 by gravity feed into the center well 16. It is received by the conveyor auger 18 and conveyed to a point of utilization external to the grain bin 11.

As previously referred to, grain may be stored within the bin for a considerable length of time. The grain, near the opening 14, under the compacting force of grain above it, can form large chunks of compacted grain. These chunks can bridge across the opening 14. The bridging over the opening 14 by this compacted grain can impede or totally prevent the grain from flowing freely from the bin, through the discharge opening 14, and then into the center well 16 for conveyance by the auger 18.

To preclude such blockage of the discharge opening 14 by the compacted grain, the guard apparatus 10 is disposed above the discharge opening 14. As will be described subsequently, the guard apparatus 10 is structured to cut and break up the compacted grain chunks which may have formed during the storage thereof so as to preclude blockage of the discharge opening 14 and assure free flow of grain therethrough upon removal of the grain from the storage bin 11.

Figure 2:
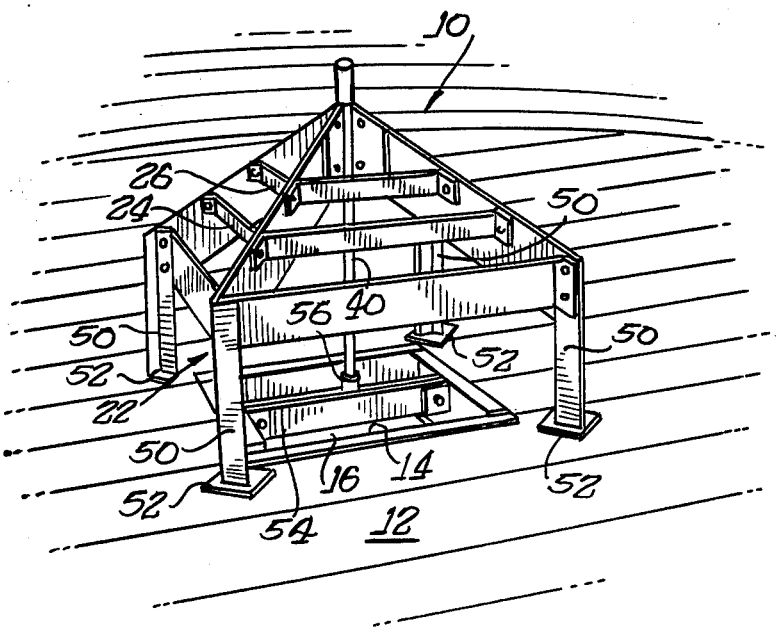
FIG. 2 is a perspective view of the guard apparatus illustrated in FIG. 1.
Figure 3:
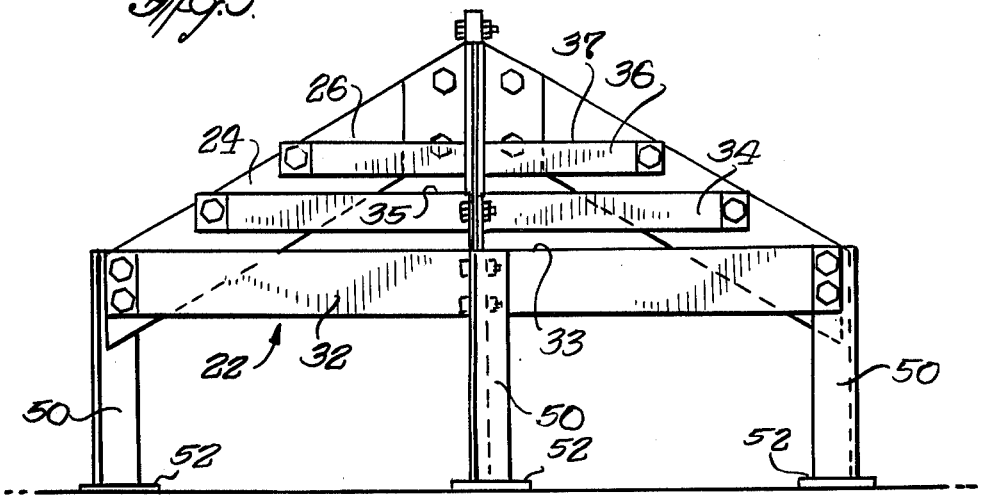
FIG. 3 is a side plan view of the guard apparatus.
Figure 4:
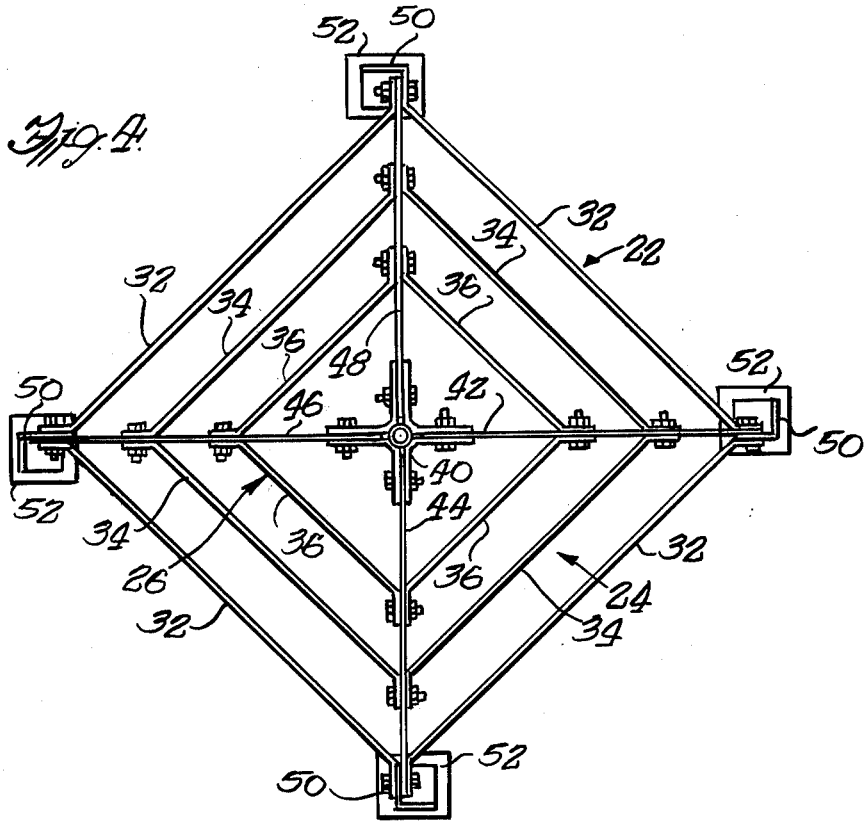
FIG. 4 is a top plan view of the guard apparatus.

Referring now to FIGS. 2–4, it will be noted that the guard apparatus 10, in accordance with the present invention, includes a plurality of knife units 22, 24 and 26. Each of the knife units includes a plurality of blades with knife unit 22 including blades 32, knife unit 24 including blades 34, and knife unit 26 including blades 36. As will be best noted in FIG. 4, the plurality of blades 32, 34 and 36 form a knife means with the blades 32, 34 and 36 being spaced apart and disposed across the discharge opening 14 above the center well 16.

The knife blades 32, 34 and 36 which form the knife units 22, 24 and 26 respectively each define a closed perimeter or periphery. Preferably, the knife units form square closed perimeters in correspondence to the perimeter of the discharge opening 14. As a result, the loads impressed upon the guard apparatus will be uniformly distributed thereacross. Also, the entire area of the discharge opening 14 is guarded by the knife units.

The blades 36, 34 and 32 define perimeters of increasing dimension and are further concentrically arranged with respect to each other and with respect to a center axis along which a securing rod member 40 extends. Hence, the blades of the respective knife units are spaced apart for breaking up the grain chunks to a sufficiently small size so as to be readily handled by the auger 18.

The knife units 22, 24 and 26 are further disposed in fixed relation to one another by being fixed to inclined cross members 42, 44, 46 and 48. These connections can be made by a plurality of nuts and bolts, or weldments, or the like. Therefore, the knife units are assembled in a unitary and rigid relation to maintain their relative positions notwithstanding the substantial loading by the grain.

The blades 32, 34 and 36 extend substantially perpendicularly to the discharge opening 14 by an extent giving each blade an axial width to provide further rigidity. The blades 32, 34 and 36 include upper edges 33, 35 and 37 respectively forming grain engaging cutting edges. As a result of the foregoing, when grain is to be removed from the storage bin through the discharge opening 14, the cutting edges of the blades will engage and cut chunks of compacted grain that might have been formed during the storage thereof to thereby break up such chunks to sufficiently small sizes to assure free flow of grain through the discharge opening 14.

As may also be best noted in FIGS. 2 and 3, the knife units are arranged in a pyramid array with the blades 32, 34 and 36 and their cutting edges 33, 35 and 37 being axially spaced apart with the cutting edges of each respective knife unit being in a common plane. In the illustrated preferred form, the cutting edges of the knife units 22, 24 and 26 are progressively spaced from the discharge opening with the innermost knife unit 26 and its blade cutting edges 37 being furthest from the discharge opening. As a result of this novel knife unit configuration, and in accordance with a particular feature and object of the present invention, any grain chunks which engage the guard unit at an angle to the blades which precludes cutting thereof by the blades can be directed downwardly and away from the discharge opening 14, and will not be permitted to bridge across the blades themselves. Alternatively, the grain chunks are engaged and held above the opening in such a manner as to permit grain to continue flowing into the opening through the sides and underneath the knife-blades of the apparatus.

For supporting the knife units 22, 24 and 26 above the discharge opening 14, the apparatus includes a plurality of leg supports 50 which at one end are secured to the knife unit 22 and at their other ends terminate in pads 52. The pads 52 are of greater surface area than the cross-sectional dimension of the leg supports 50 to evenly distribute the weight of the knife units about the discharge opening 14 upon the floor 12 of the storage bin 11.

As best seen in FIG. 2, the discharge opening 14 is provided with a cross member 54 to which a tubular fitting 56 is secured as by welding or the like. The center rod member 40 is adapted to fit within the tubular fitting 56 so as to fix the guard apparatus 10 in an operative position and prevent lateral shifting of the knife units 22, 24 and 26.

When it is desired to totally empty the storage bin 11, such as by introducing a sweep auger into the storage bin, the guard apparatus 10 may be simply lifted from its operative position until the rod member 40 disengages the tubular fitting 56. Thereafter, the guard apparatus 10 may be removed from the storage bin to facilitate the complete emptying of the storage bin by the sweep auger.

In operation, when grain is removed from the storage bin 11 by the actuation of the auger conveyor 18, the grain is gravity fed through the discharge opening 14 into the center well 16 for being received by the conveyor auger 18. Any chunks of compacted grain which may have been formed during the storage of the grain will engage the cutting edges of the knife units 22, 24 and 26. As the chunks of compacted grain engage the knife units, they will be cut and broken up by the knife cutting edges to permit the free flow of grain through the discharge opening 14 to the conveyor auger 18. Once the storage bin 11 has been substantially totally emptied, the guard apparatus 10 may be readily removed in the previously described manner, and a sweep auger is then manually introduced into the storage bin. Thereafter, the sweep auger may be utilized to facilitate complete emptying of the grain bin 11 by pulling the remaining grain toward the discharge opening.

From the foregoing, it can be appreciated that the present invention provides a guard apparatus for the discharge opening of a grain bin which precludes blockage of the discharge opening by compacted grain or the like. Grain chunks are engaged and held away from the opening to permit grain flow around and under the chunks and the opening. The guard apparatus in accordance with a particular feature of the present invention is portable and thus removable from its operative position over the discharge opening so as to permit the complete emptying of the storage bin by a sweep auger or the like thereafter introduced into the bin.

While a particular embodiment of the present invention has been shown and described, modifications may be made, and it is therefore intended to cover in the appended claims all such changes and modifications which fall within the true spirit and scope of the invention as defined in said claims.

The invention is claimed as follows:

1. A guard apparatus for the discharge opening of a grain bin to preclude blockage of said opening by compacted grain or the like comprising: knife means including a plurality of knife units, each said knife unit defining a closed perimeter, and said knife units being concentrically arranged with respect to each other, each knife unit having a plurality of spaced apart blades adapted to be disposed over said discharge opening, said blades extending substantially perpendicularly to said discharge opening and having grain engaging cutting edges for cutting and breaking up compacted grain over said discharge opening to enable free flow of grain through said opening.

2. An apparatus as defined in claim 1 wherein the perimeters of said knife units are shaped in correspondence to the perimeter of the discharge opening.

3. An apparatus as defined in claim 1 wherein said knife units are disposed about a center axis and wherein said grain engaging cutting edges of said knife units are axially spaced apart.

4. An apparatus as defined in claim 3 wherein the grain engaging cutting edges of each respective knife unit lie within a common plane.

5. An apparatus as defined in claim 4 wherein the spacing between said grain engaging cutting edges and said discharge opening decreases from the innermost knife unit to the outermost knife unit.

6. An apparatus as defined in claim 5 wherein said knife unit perimeters define concentric squares.

7. An apparatus as defined in claim 1 further including a plurality of leg supports for supporting said knife units above said discharge opening.

8. An apparatus as defined in claim 7 wherein each said leg support terminates in a pad of greater surface area than the cross-sectional dimension of said legs for evenly distributing the weight of said knife units about said discharge opening.

9. An apparatus as defined in claim 7 wherein said knife units are adapted to be secured in an operative position over said discharge opening and readily removable from said secured operative position.

10. An apparatus as defined in claim 9 further including a securing member extending along the center axis of said concentric knife units to said discharge opening and arranged to secure said knife units in said operative position.

11. A guard for the discharge opening of a grain bin wherein said opening is arranged to pass the grain therethrough by gravity feed to a conveyor means and wherein said guard precludes blockage of the opening by compacted grain, said guard comprising: a plurality of knife units disposed over said opening, each said knife unit including a plurality of blades defining a closed periphery, said knife units being concentric with respect to each other about a central axis and said blades extending substantially perpendicularly to said opening and including grain engaging edges for cutting and breaking up compacted grain to assure free flow of grain through said opening.

12. A guard as defined in claim 11 further including a plurality of leg supports for disposing said guard over said opening.

13. A guard as defined in claim 12 wherein said leg supports terminate in pads for distributing the weight of said guard about said opening.

14. A guard as defined in claim 11 wherein the blades of said concentric knife units define concentric squares.

15. A guard as defined in claim 14 wherein said knife units are axially spaced apart.

16. A guard as defined in claim 15 wherein said knife units are progressively spaced from said opening with the innermost knife unit being furthest from said opening.

17. A guard as defined in claim 11 further including securing means for securing said guard in an operative position over said opening.

18. A guard as defined in claim 17 wherein said opening includes an interlocking fitting and wherein said securing means comprises a rod member extending along said central axis to said opening for lockingly engaging said interlocking fitting.

19. A guard as defined in claim 18 wherein said rod member is releasable from said fitting for removing said guard from said opening.

* * * * *